US008579468B2

(12) United States Patent
Wagatsuma et al.

(10) Patent No.: US 8,579,468 B2
(45) Date of Patent: Nov. 12, 2013

(54) SEMICONDUCTOR LIGHT-EMITTING ELEMENT MOUNTING MODULE, SEMICONDUCTOR LIGHT-EMITTING ELEMENT MODULE, SEMICONDUCTOR LIGHT-EMITTING ELEMENT LIGHT FIXTURE, AND MANUFACTURING METHOD OF SEMICONDUCTOR LIGHT-EMITTING ELEMENT MOUNTING MODULE

(75) Inventors: Toru Wagatsuma, Kanagawa (JP); Atsushi Sato, Kanagawa (JP)

(73) Assignee: Kyocera Connector Products Corporation (JP)

( * ) Notice: Subject to any disclaimer, the term of this patent is extended or adjusted under 35 U.S.C. 154(b) by 265 days.

(21) Appl. No.: 13/218,823

(22) Filed: Aug. 26, 2011

(65) Prior Publication Data

US 2012/0051052 A1 Mar. 1, 2012

(30) Foreign Application Priority Data

Aug. 27, 2010 (JP) ..... 2010190780

(51) Int. Cl.
*F21V 21/00* (2006.01)
*F21V 17/00* (2006.01)
*H01R 13/66* (2006.01)

(52) U.S. Cl.
USPC ..... 362/249.02; 362/249.01; 362/800

(58) Field of Classification Search
USPC ..... 362/249.01, 249.02, 800
See application file for complete search history.

(56) References Cited

U.S. PATENT DOCUMENTS

| | | | | |
|---|---|---|---|---|
| 5,404,282 | A * | 4/1995 | Klinke et al. | 362/249.06 |
| 6,386,733 | B1 * | 5/2002 | Ohkohdo et al. | 362/249.06 |
| 7,201,511 | B2 * | 4/2007 | Moriyama et al. | 362/646 |
| 7,566,147 | B2 * | 7/2009 | Wilcox et al. | 362/249.02 |
| 7,985,002 | B2 * | 7/2011 | Wu | 362/249.02 |
| 2004/0252501 | A1 * | 12/2004 | Moriyama et al. | 362/238 |

* cited by examiner

*Primary Examiner* — Stephen F Husar
*Assistant Examiner* — James Cranson, Jr.
(74) *Attorney, Agent, or Firm* — McCormick, Paulding & Huber LLP

(57) ABSTRACT

A semiconductor light-emitting element mounting module includes a conductive plate including semiconductor light-emitting fixing portions and first and second electrical-supply segments, wherein the semiconductor light-emitting fixing portions includes first and second conductive sections in contact with one end of first and second contacts, the other end of the first and second contacts is conductive with an anode and a cathode of an light-emitting element, a pair of the first and second electrical-supply segments are electrically conductive with the first and second conductive sections at one end of the conductive plate, and the other pair of the first and second electrical-supply segments are conductive with the first and second conductive sections at other end of the conductive plate; and a resin surface-insulation portion covering the conductive plate with the other end of the first and second contacts exposed, and with the first and second electrical-supply segments exposed.

22 Claims, 8 Drawing Sheets

SEMICONDUCTOR LIGHT-EMITTING ELEMENT MOUNTING MODULE, SEMICONDUCTOR LIGHT-EMITTING ELEMENT MODULE, SEMICONDUCTOR LIGHT-EMITTING ELEMENT LIGHT FIXTURE, AND MANUFACTURING METHOD OF SEMICONDUCTOR LIGHT-EMITTING ELEMENT MOUNTING MODULE

CROSS REFERENCE TO RELATED APPLICATION

The present invention is related to and claims priority of the following co-pending application, namely, Japanese Patent Application No. 2010-190780 filed on Aug. 27, 2010.

BACKGROUND OF THE INVENTION

1. Field of the Invention

The present invention relates to a semiconductor light-emitting element mounting module to which a plurality of semiconductor light-emitting elements (LEDs) can be mounted, a semiconductor light-emitting element module, and a semiconductor light-emitting element light fixture that utilizes the semiconductor light-emitting element module. The present invention also relates to a manufacturing method of the semiconductor light-emitting element mounting module.

2. Description of Related Art

In recent years, light fixtures which utilize LEDs (semiconductor light-emitting elements) have been used in various fields, such as for an interior light fixture or a backlight for used in an LCD monitor, etc.

A light fixture which utilizes LEDs is typically configured by arranging a large number of circuit boards (rigid substrates), onto which one or a plurality of LEDs are installed on one surface, in a chain-like manner (either linear or planar), and connecting adjacent circuit boards with an electrical connector.

Examples of the related art are disclosed in Japanese Patent Domestic Announcement Nos. 2010-525523 and 2010-505232, and Japanese Patent Publication Nos. 2010-62556 and 2010-98302.

In order to assemble an LED light fixture of the related art, it is necessary to connect a plurality of circuit boards into a chain-like manner by utilizing electrical connectors. However, since the connecting parts of the electrical connectors cannot be completely secured to each other, it is necessary to screw-fasten each connecting part onto a chassis or seat; hence, increasing the number of processes during assembly, and causing extremely bad productivity.

Note that if each circuit board is formed longer or formed to have a larger surface area, since the electrical connectors can be omitted or the number of electrical connectors can be reduced, the number of processes during assemble can be reduced. However, in general, if the circuit boards are formed in an elongated (longer) manner or formed to have a larger surface area, the circuit board itself is susceptible to warping during the formation thereof, and warping easily occurs during reflow surface-mounting (soldering) onto the LED circuit boards; if warping occurs, the LEDs cannot be properly positioned in a common plane. Furthermore, due to the circuit board having a larger size (longer or larger in surface area), the size of the reflow apparatus must also be enlarged, causing accommodation restraints.

Furthermore, in an LED light fixture, the LEDs also emit a large amount of heat, and this heat transfers from the LEDs to each circuit board, so that the circuit boards radiate heat. However, in general, since the majority of each circuit board that is used with reflow surface-mounting is formed from a resin material or glass fiber, etc., in order to ensure insulation between the circuits and in order to prevent an abnormal temperature increase of the circuit board during mounting and formation of the circuit board via reflowing, the circuit board itself has a low thermal-radiativity.

SUMMARY OF THE INVENTION

The present invention provides a semiconductor light-emitting element mounting module, a semiconductor light-emitting element module, and a semiconductor light-emitting element light fixture which exhibit excellent productivity and radiativity. The present invention also provides a method of manufacturing the semiconductor light-emitting element mounting module.

According to an aspect of the present invention, a semiconductor light-emitting element mounting module is provided, including a conductive plate including a plurality of semiconductor light-emitting fixing portions arranged along the conductive plate, and two pairs of first and second electrical-supply segments, wherein each of the semiconductor light-emitting fixing portions includes a first conductive section and a second conductive section; and a first contact and a second contact, wherein one end of the first contact and one end of the second contact are in contact with the first conductive section and the second conductive section, respectively, and the other end of the first contact and the second contact is electrically conductive with an anode and a cathode of an light-emitting element, respectively, and wherein one pair of the first and second electrical-supply segments are electrically conductive with the first and second conductive sections that are provided at one end of the conductive plate, respectively, and the other pair of the first and second electrical-supply segments are electrically conductive with the first and second conductive sections that are provided at the other end of the conductive plate, respectively; and a surface-insulation portion formed from a resin material and which covers the surface of the conductive plate with the other end of the first and second contacts exposed, and with each of the first electrical-supply segments and each of the second electrical-supply segments exposed.

In an LED light fixture of the related art, it is necessary to connect a large number of adjacent substrates in a mutually chain-like manner (linear or planar) in order to mount a large number of semiconductor light-emitting elements. However, in the present invention, since a large number of semiconductor light-emitting elements can be mounted onto one semiconductor light-emitting element mounting module, the assembly and manufacture of the semiconductor light-emitting element module (semiconductor light-emitting element mounting module) are easy, and the number of procedures that are included in the installation of the semiconductor light-emitting element module to a device (for example LCD monitor) can be reduced, thus an excellent productivity can be exhibited.

The major part of the semiconductor light-emitting element mounting module can be formed from a metal conductive plate which has excellent thermal-conductivity and rigidity, and it is also possible to have a configuration in which the thickness of the metal conductive plate is increased and the entire conductive plate is coated with a surface-insulation portion that is made of resin. Accordingly, the module of the present invention exhibits superior thermal-conductivity and thermal-radiativity compared to modules used in laminated substrates of the related art, so that heat which is generated by the semiconductor light-emitting elements can be externally radiated in an effective manner via the conductive plate and the thin surface-insulation portion.

Furthermore, since connecting portions are unnecessary, the module of the present invention exhibits a superior rigidity compared to a module structure in which circuit boards are connected in a chain-like manner. Moreover, since conductive circuits and portions of the metal layers of the laminated substrate, which were not intended at the design stage, can be prevented from being exposed at the surface, the module has superior insulation and protection capabilities, so that adhering of unintentional foreign matter and short-circuiting can be prevented.

It is desirable for a pair of fixing pieces to be provided on the each of the semiconductor light-emitting fixing portions, wherein each the pair of fixing pieces can clasp the semiconductor light-emitting element so as to fix the semiconductor light-emitting element to a corresponding the semiconductor light-emitting fixing portion, and wherein the surface-insulation portion exposes each the pair of fixing pieces.

Accordingly, since the semiconductor light-emitting element can be fixed by being fitted onto the conductive plate, the semiconductor light-emitting element does not need to be reflow soldered onto the conductive plate, and a favorable productivity can be achieved.

Furthermore, since no reflow is necessary, there is no danger of the semiconductor light-emitting element being damaged by heat that would otherwise be generated.

Moreover, since the heat generated by the semiconductor light-emitting element can be effectively transferred to the conductive plate through a fixing piece, the thermal-conductivity and the thermal-radiativity are improved.

It is desirable for each of the first conductive sections, which are mutually separated from each other, to be electrically conductive with a corresponding the second conductive section, which is provided on a common the semiconductor light-emitting fixing portion, and to be connected with another the second conductive section of another the semiconductor light-emitting fixing portion that is positioned in a longitudinal direction of the conductive plate.

Accordingly, since a series circuit that has minimal variation in the current value is formed on the conductive plate, variation of the luminance of the semiconductor light-emitting elements is hence minimal.

It is desirable for the first conductive sections to be mutually connected to each other, and for the second conductive sections to be mutually connected to each other, wherein the first and second conductive sections are mutually separate from each other, and wherein each of the first conductive sections is conductive with a corresponding the second conductive section which is provided on a common the semiconductor light-emitting fixing portion.

Accordingly, since a parallel circuit is formed on the conductive plate, even if one semiconductor light-emitting element were to deteriorate or break, the other semiconductor light-emitting elements which are provided on the module can still emit light, which is ideal for a device to which a long operating life and reliability are demanded.

It is desirable for the first conductive sections to be mutually connected to each other, and for the second conductive sections to be mutually connected to each other, wherein only the first and second conductive segments of the semiconductor light-emitting fixing portion which is positioned at one end of the conductive plate are mutually connected, and wherein each of the first conductive sections is conductive with a corresponding the second conductive section which is provided on a common the semiconductor light-emitting fixing portion.

Accordingly, the amount of circuitry can be reduced compared to the above-described parallel circuit structure while achieving the same effect.

It is desirable for the first and second contacts to include first and second contact pieces, respectively, wherein each of the first and second contact pieces is formed as a separate member from the semiconductor light-emitting fixing portion and is formed by a resilient metal, and wherein one end of the first contact piece and one end of the second contact piece are in contact with the first conductive section and the second conductive section, respectively, and the other end of the first contact and the second contact is separated from the semiconductor light-emitting fixing portion and is electrically conductive with an anode and a cathode of an light-emitting element, respectively.

Accordingly, since only the first contact and the second contact are made of metal material having superior spring properties, and a metal material that does not have spring properties can be used for the other part of the conductive plate, the parts that have spring properties can be reduced, so that the manufacturing cost of the entire conductive plate can be reduced.

It is desirable for the semiconductor light-emitting fixing portion to be wider than the width of the remaining portions of the conductive plate.

Accordingly, since the portions other than the semiconductor light-emitting element fixing portions, which mainly exhibit a radiation effect, can be made fine (narrow), the conductive plate and the surface-insulation portion can be made lighter in weight, and the manufacturing cost of the module can be reduced.

It is desirable for the surface-insulation portion to include at least one exposed portion for exposing part of the conductive plate.

Accordingly, since the heat that is transferred from the semiconductor light-emitting elements to the conductive plate externally radiates heat through the exposed portions, the thermal-radiativity further improves. Furthermore, this structure achieves an increased freedom in the thermal design of the device (e.g., an LCD television) to which the semiconductor light-emitting element mounting module is installed.

It is desirable for the first conductive section to be connected to the corresponding second conductive section which is provided on the common semiconductor light-emitting fixing portion by a cutoff bridge, wherein the cutoff bridge can be physically cut off from the common semiconductor light-emitting fixing portion.

Accordingly, since the first conductive section and the second conductive section can be made integral via the cutoff bridge, each part (for example the semiconductor light-emitting fixing portion) of the conductive plate can maintain a high positional accuracy having no deviation upon the formation of the surface insulation portion. Furthermore, the first conductive section and the second conductive section can be separated from each other by physically cutting the cutoff bridge after forming the surface-insulation portion.

It is desirable for the surface-insulation portion to include a support portion for supporting a diffusing lens, which diffuses light that is emitted from the semiconductor light-emitting element.

Accordingly, a lens can be positioned at an appropriate position with respect to the semiconductor light-emitting element. Furthermore, since a lens having a diffusing function can be disposed close to the semiconductor light-emitting element, the light that is emitted by the semiconductor light-emitting element can be effectively diffused, and the height of the module that includes a plurality of such lenses can be reduced.

In an embodiment, a semiconductor light-emitting element module is provided, including the above-described semiconductor light-emitting element mounting module; and a light-emitting element, wherein an anode and a cathode of the light-emitting element are electrically conductive with the first contact portion and the second contact portion, respectively, of the semiconductor light-emitting element mounting module.

In an embodiment, a semiconductor light-emitting element light fixture is provided, including a plurality of the above-described semiconductor light-emitting element modules, the plurality of semiconductor light-emitting element modules being arranged in a direction that is orthogonal to the longitudinal direction of the conductive plates; a plurality of pairs of first connecting members, wherein one of each the pair of first connecting members mutually connects with the first electrical-supply segments at one common end of the semiconductor light-emitting element mounting modules, and the other of the each pair of first connecting members mutually connects with the first electrical-supply segments at the other common end of the semiconductor light-emitting element mounting modules; a plurality of pairs of second connecting members, wherein one of each the pair of second connecting members mutually connects with the second electrical-supply segments at the one common end of the semiconductor light-emitting element mounting modules, and the other of the each pair of second connecting members mutually connects with the second electrical-supply segments at the other common end of the semiconductor light-emitting element mounting modules; and a pair of insulators, wherein one of the pair of insulators supports the first connecting members and the second connecting members at the one common end of the semiconductor light-emitting element mounting modules, and the other of the pair of insulators supports the first connecting members and the second connecting members at the other common end of the semiconductor light-emitting element mounting modules.

In an embodiment, a semiconductor light-emitting element light fixture is provided, including a plurality of the above-described semiconductor light-emitting element modules, the plurality of semiconductor light-emitting element modules being arranged in a direction that is orthogonal to the longitudinal direction of the conductive plates; a plurality of pairs of first connecting members, wherein one of each the pair of first connecting members mutually connects with the first electrical-supply segments at one common end of the semiconductor light-emitting element mounting modules; a plurality of pairs of second connecting members, wherein one of each the pair of second connecting members mutually connects with the second electrical-supply segments at the one common end of the semiconductor light-emitting element mounting modules; and an insulator which supports the first connecting members and the second connecting members, respectively.

Accordingly, the semiconductor light-emitting element light fixture of the present invention can be assembled in a simple manner compared to that of the related art.

It is desirable for at least one of the first connecting member and the second connecting member to include a metal connecting member including a connector which connects to one of the first electrical-supply segment and the second electrical-supply segment, and a conduction groove; and an electrical wire which is supported by the conduction groove.

It is desirable for the connector to include a pair of resilient contacts which clasps both surfaces of one of the first electrical-supply segment and the second electrical-supply segment.

Accordingly, each adjacent semiconductor light-emitting element mounting module (semiconductor light-emitting element module) can be simply connected together.

It is desirable for the semiconductor light-emitting element light fixture to include a chassis, which is provided with a circuit and a plurality of metal conductive pins which are connected to the circuit, wherein the semiconductor light-emitting element modules are fixed onto the chassis, wherein each of the first conductive sections and the second conductive sections are mutually separated from each other. The surface-insulation portion is provided with at least one exposed portion for partially exposing each of the first conductive sections and the second conductive sections. The conductive pins are brought in contact with the first conductive sections and the second conductive sections through the at least one exposed portion.

Accordingly, the circuit design can be freely carried out by merely changing the number and arrangement of the conductive pins that are provided on the chassis.

It is desirable for the chassis to be formed of metal.

Accordingly, the thermal-radiation effect can be further improved.

In an embodiment, a manufacturing method of a semiconductor light-emitting element mounting module is provided, including stamp-forming a conductive plate, the conductive plate including a plurality of semiconductor light-emitting fixing portions linearly arranged along the conductive plate, two pairs of first and second electrical-supply segments, and a cutoff bridge, wherein each of the semiconductor light-emitting fixing portions includes a first conductive section and a second conductive section; and a first contact and a second contact, wherein one end of the first contact and one end of the second contact are in contact with the first conductive section and the second conductive section, respectively, and the other end of the first contact and the second contact is electrically conductive with an anode and a cathode of an light-emitting element, respectively, wherein one pair of the first and second electrical-supply segments are electrically conductive with the first and second conductive sections that are provided at one end of the conductive plate, respectively, and the other pair of the first and second electrical-supply segments are electrically conductive with the first and second conductive sections that are provided at the other end of the conductive plate, respectively, wherein the first conductive section is connected to a corresponding the second conductive section which is provided on a common semiconductor light-emitting fixing portion by the cutoff bridge, wherein the cutoff bridge can be physically cut off from the common semiconductor light-emitting fixing portion, and wherein the first conductive section is connected to the second conductive section of another of the semiconductor light-emitting fixing portions, which is positioned to one side of the semiconductor light-emitting fixing portion of the first conductive section in the longitudinal direction of the conductive plate; covering the surface of the conductive plate with a surface-insulation portion which is formed of resin with the other end of the first and second contacts exposed, and with each of the first electrical-supply segments and each of the second electrical-supply segments exposed; and physically cutting off each of the cutoff bridges.

Accordingly, a semiconductor light-emitting element mounting module having excellent productivity and thermal-radiativity can be easily assembled.

In an embodiment, a manufacturing method of a semiconductor light-emitting element mounting module is provided, including stamp-forming a conductive plate, the conductive plate including a plurality of semiconductor light-emitting fixing portions linearly arranged along the conductive plate, two pairs of first and second electrical-supply segments, and a cutoff bridge, wherein each of the semiconductor light-emitting fixing portions includes a first conductive section and a second conductive section; and a first contact and a second contact, wherein one end of the first contact and one end of the second contact are in contact with the first conductive section and the second conductive section, respectively, and the other end of the first contact and the second contact is electrically conductive with an anode and a cathode of an light-emitting element, respectively, wherein one pair of the first and second electrical-supply segments are electrically conductive with the first and second conductive sections that are provided at one end of the conductive plate, respectively, and the other pair of the first and second electrical-supply segments are electrically conductive with the first and second conductive sections that are provided at the other end of the conductive plate, respectively, wherein the first conductive section is connected to a corresponding the second conductive section which is provided on a common semiconductor light-emitting fixing portion by the cutoff bridge, wherein the cutoff bridge can be physically cut off from the common semiconductor light-emitting fixing portion, and wherein the first conductive sections are connected to each other, and the second conductive sections are connected to each other; covering the surface of the conductive plate with a surface-insulation portion which is formed of resin with the other end of the first and second contacts exposed, and with each of the first electrical-supply segments and each of the second electrical-supply segments exposed; and physically cutting off each of the cutoff bridges.

In an embodiment, a manufacturing method of a semiconductor light-emitting element mounting module is provided, including stamp-forming a conductive plate, the conductive plate including a plurality of semiconductor light-emitting fixing portions linearly arranged along the conductive plate, two pairs of first and second electrical-supply segments, an end bridge, and a cutoff bridge, wherein each of the semiconductor light-emitting fixing portions includes a first conductive section and a second conductive section; and a first contact and a second contact, wherein one end of the first contact and one end of the second contact are in contact with the first conductive section and the second conductive section, respectively, and the other end of the first contact and the second contact is electrically conductive with an anode and a cathode of an light-emitting element, respectively, wherein one pair of the first and second electrical-supply segments are electrically conductive with the first and second conductive sections that are provided at one end of the conductive plate, respectively, and the other pair of the first and second electrical-supply segments are electrically conductive with the first and second conductive sections that are provided at the other end of the conductive plate, respectively, wherein the end bridge connects the first conductive section to the second conductive section, which are positioned at one end of the conductive plate in the longitudinal direction thereof; and the cutoff bridge connects the first conductive section to a corresponding the second conductive section which is provided on a common the semiconductor light-emitting fixing portion, wherein the cutoff bridge can be physically cut off from the common semiconductor light-emitting fixing portion, and wherein the first conductive sections are connected to each other, and the second conductive sections are connected to each other; covering the surface of the conductive plate with a surface-insulation portion which is formed of resin with the other end of the first and second contacts exposed, and with each of the first electrical-supply segments and each of the second electrical-supply segments exposed; and physically cutting off each of the cutoff bridges.

Accordingly, a semiconductor light-emitting element mounting module having excellent productivity and thermal-radiativity can be easily assembled.

BRIEF DESCRIPTION OF THE DRAWINGS

The present invention will be discussed below in detail with reference to the accompanying drawings, in which.

DESCRIPTION OF THE EMBODIMENTS

Figure 1:
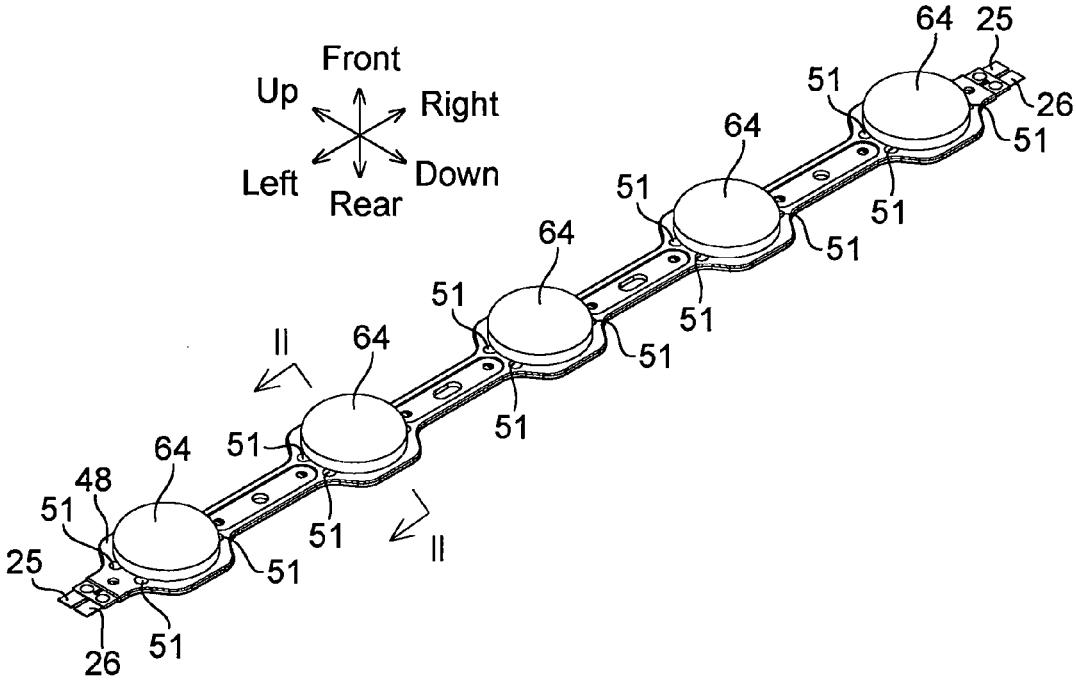
FIG. 1 is a perspective view of an LED mounting module according to an embodiment of the present invention.

An embodiment of the present invention will be herein described with reference to the appended drawings. Note that in the following descriptions, the upward/downward, left/right and forward/rearward directions are based on the directions of the arrows that are respectively indicated in the drawings.

Figure 16:
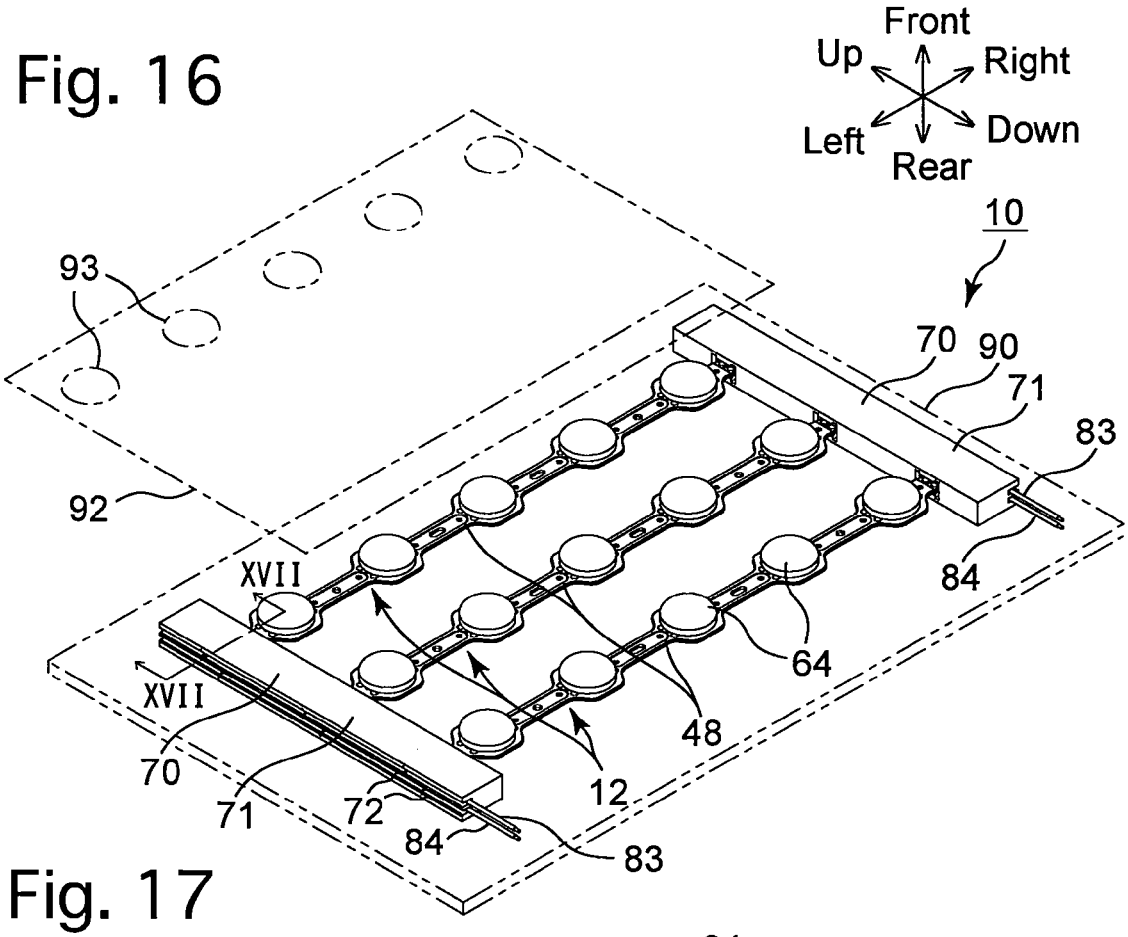
FIG. 16 is a perspective view of an LED light fixture showing the plurality of LED modules and the pair of side-connectors connected to a chassis, and with a reflector plate disassembled therefrom.
Figure 17:
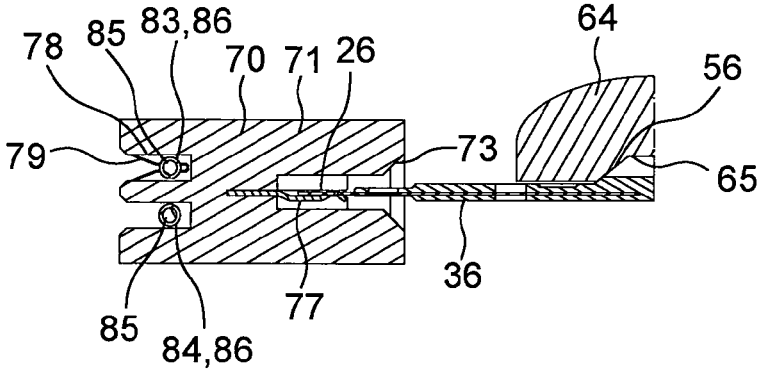
FIG. 17 is an enlarged sectional view taken along the XVII-XVII line shown in FIG. 16, viewed in the direction of the appended arrows.

In the illustrated embodiment, the present invention is applied to an LED light fixture 10. The LED light fixture 10 can be used as, e.g., a backlight of an LCD panel (not shown). As shown in FIG. 16, the LED light fixture 10 is provided with LED modules (semiconductor light-emitting element modules) 12, a pair of side connectors 70, a chassis 90, and a reflector plate 92 as main components.

Firstly, details of the structure of the LED module 12 will be described using FIGS. 1 through 14. Note that the LED module 12 in the following descriptions has five LED elements 60 mounted thereon for the sake of convenience (due to size limitations of the drawings), however, the LED elements 60 that are mounted on the LED module 12 can be a number that corresponds to the size of the LED light fixture 10.

The LED module 12 is configured of a plurality of LED elements 60 and a corresponding number of diffusing lenses 64 mounted onto the LED mounting module 15.

The LED mounting module 15 is provided with a conductive plate 17, which constitutes a substrate. The conductive plate 17 is provided with a base plate portion 20, anode pieces 39 and cathode pieces 43.

Figure 11:
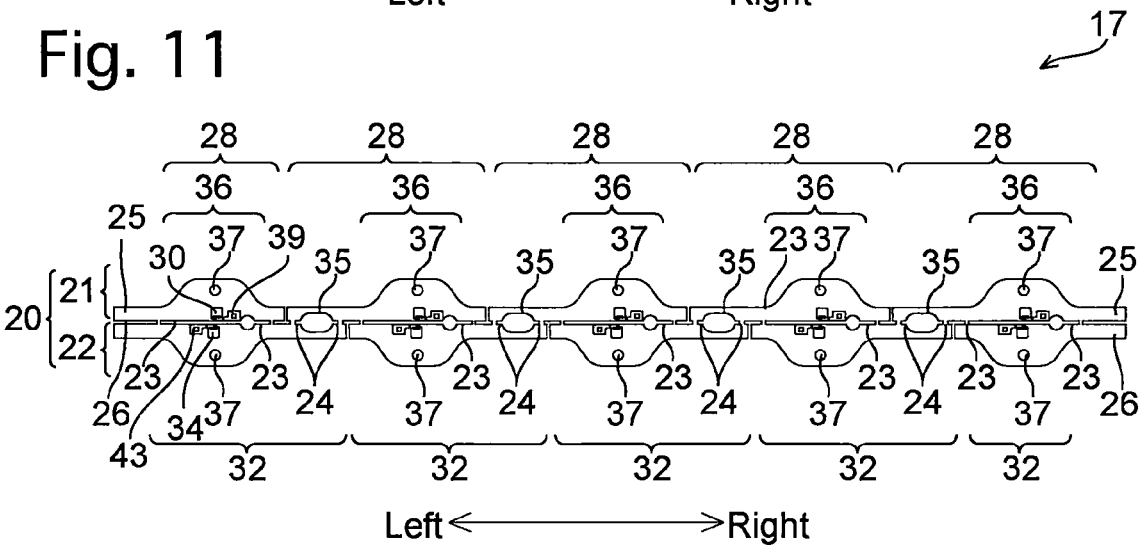
FIG. 11 is a front elevational view of a conductive plate which is formed for use in a series circuit.
Figure 12:
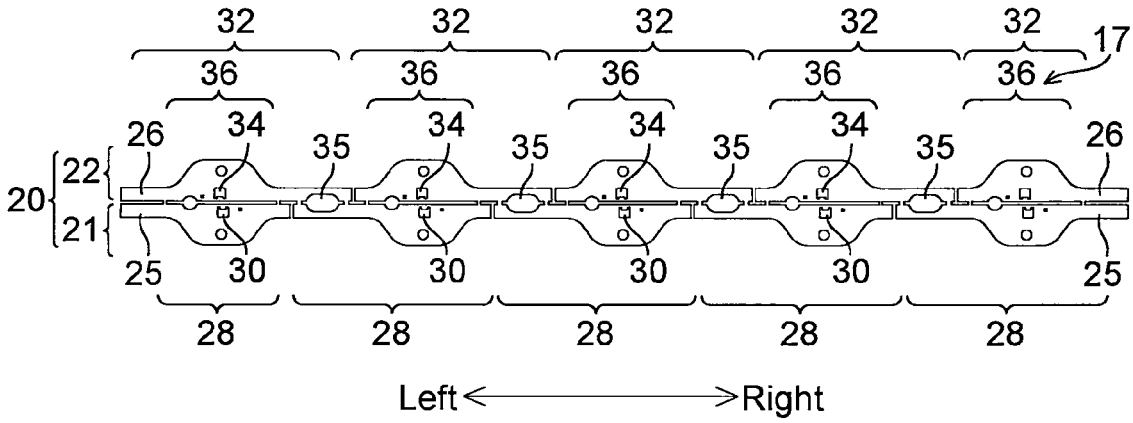
FIG. 12 is an underside view of the conductive plate which is formed for use in a series circuit.

The base plate portion 20 shown in FIGS. 11 and 12 is an elongated member that extends in the left/right direction and is formed by stamping sheet metal, e.g., brass, phosphor bronze, iron, aluminum, etc. The base plate portion 20 is divided into an anode half-section 21 and a cathode half-section 22, which constitute an upper half and a lower half of the base plate portion 20, respectively. The shape of the base plate portion 20 is symmetrical about the central point thereof. In the illustrated embodiment, the anode half-section 21 and the cathode half-section 22 are mutually connected via a total of ten cutoff bridges 23 and a total of eight circuit-design bridges 24. An anode electrical-supply segment (first electrical-supply segment) 25 is formed on each of the left and right ends of the anode half-section 21, and a cathode electrical-supply segment (second electrical-supply segment) 26 is formed on each of the left and right ends of the cathode half-section 22. The anode half-section 21 except for the left and right anode electrical-supply segments 25 is partitioned into a total of five anode conductive sections (first conductive sections) 28 which are mutually separated from each other. Furthermore, each anode conductive section 28 is provided with a cut-and-raised first holding segment (fixing piece) 30 which extends in the forward direction. The cathode half-section 22 except for the left and right cathode electrical-supply segments 26 is partitioned into a total of five cathode conductive sections (second conductive sections) 32 which are mutually separated from each other. Furthermore, each cathode conductive section 32 is provided with a cut-and-raised second holding segment (fixing piece) 34 which extends in the forward direction. Furthermore, in the illustrated embodiment, the base plate portion 20 is provided with four through-holes 35 which are each positioned in between a pair of the circuit-design bridges 24 and extend over the anode half-section 21 and the cathode half-section 22.

As shown in the drawings, the base plate portion 20 is provided with LED fixing portions (semiconductor light-emitting element fixing portions) 36 at five positions along the longitudinal direction of the base plate portion 20 at equal intervals and have a wider width compared to the remaining portions of the base plate portion 20 in the vertical direction (the anode half-section 21 defines the upper section and the cathode half-section 22 defines the lower section). The anode half-section 21 portion and the cathode half-section 22 portion of each LED fixing portion 36 are respectively provided with a circular register through-hole 37.

Figure 14:
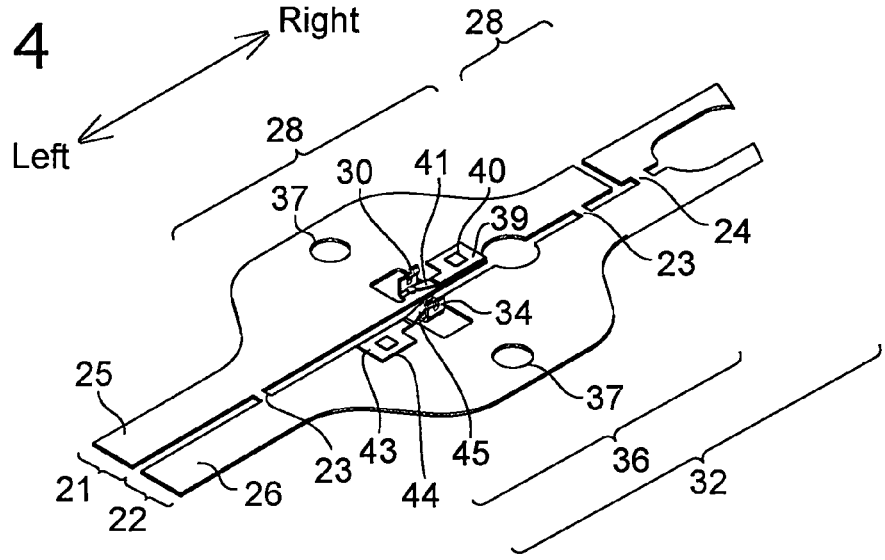
FIG. 14 shows an enlarged perspective view of an LED fixing part.

As shown in FIG. 14, an anode piece (first contact/first contact piece) 39, which is formed from, e.g., a phosphor bronze resilient material, is installed onto the anode conductive section 28 of each LED fixing portion 36. Each anode piece 39 is connected to one LED fixing portion 36 (anode half-section 21) and is provided with a substantially rectangular fixing section 40 that is fixed to (connected to) the LED fixing portion 36 by swaging or welding, etc., and a cantilever-shaped resiliently deformable portion 41 which extends from the fixing section 40 and extends away from the LED fixing portion 36 (anode half-section 21) in a forward direction. As shown in the drawings, the resiliently deformable portion 41 is positioned immediately below the first holding segment 30 that is formed on the LED fixing portion 36 (to which this resiliently deformable portion 41 corresponds), and the resiliently deformable portion 41 is resiliently deformable in the forward/rearward directions about a connecting section (base) between the resiliently deformable portion 41 and the fixing section 40. Furthermore, a cathode piece (second contact/second contact piece) 43, which is formed from the same material and has the same shape as the anode piece 39, is installed onto the cathode conductive section 32 of each LED fixing portion 36. Each cathode piece 43 is connected to one LED fixing portion 36 (cathode half-section 22) and is provided with a substantially rectangular fixing section 44 that is fixed to (connected to) the LED fixing portion 36 by swaging or welding, etc., and a cantilever-shaped resiliently deformable portion 45 which extends from the fixing section 44 and extends away from the LED fixing portion 36 (cathode half-section 22) in a forward direction. As shown in the drawings, the resiliently deformable portion 45 is positioned immediately above the second holding segment 34 that is formed on the same LED fixing portion 36 (to which this the resiliently deformable portion 45 corresponds), and the resiliently deformable portion 45 is resiliently deformable in the forward/rearward directions about a connecting section (base) between the resiliently deformable portion 45 and the fixing section 44.

The surface of the conductive plate 17 (the base plate portion 20, the anode piece 39 and the cathode piece 43) having the above described structure is coated with a resin (e.g., PBT, LCP, Nylon, etc.).

Figure 6:
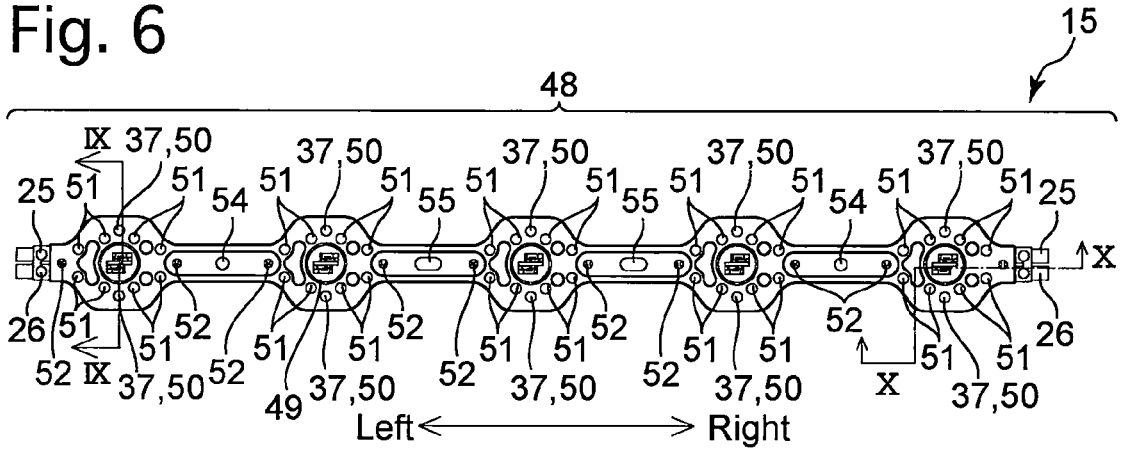
FIG. 6 is a front elevational view of the LED mounting module with the diffusing lenses and LED elements removed.
Figure 7:
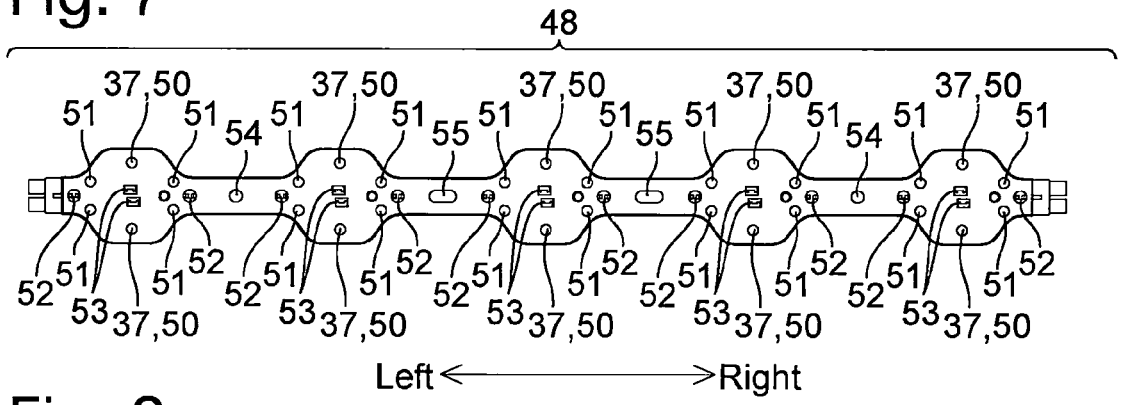
FIG. 7 is an underside view of the LED module.
Figure 8:
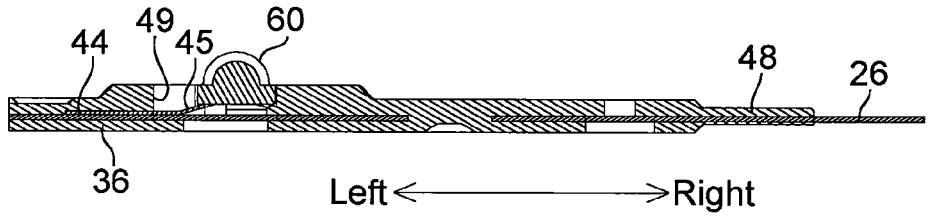
FIG. 8 is an enlarged sectional view taken along the VIII-VIII line shown in FIG. 5, viewed in the direction of the appended arrows.
Figure 9:
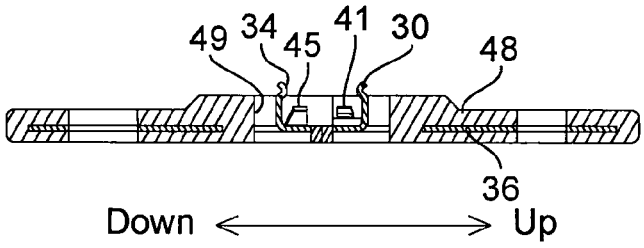
FIG. 9 is an enlarged sectional view taken along the IX-IX line shown in FIG. 6, viewed in the direction of the appended arrows.
Figure 10:
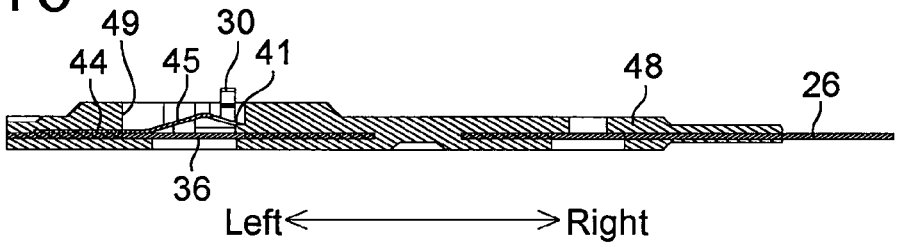
FIG. 10 is an enlarged sectional view taken along the X-X line shown in FIG. 6, viewed in the direction of the appended arrows.

When this resin coating (outsert molding) is carried out, each register through-hole 37 of the anode half-section 21 and of the cathode half-section 22 is fitted onto a corresponding projecting register-pin provided within a mold die (not shown) with each of the cutoff bridges 23 and the circuit-design bridges 24 still connected, so that the base plate portion 20 (the anode half-section 21 and the cathode half-section 22) is supported with the base plate portion 20 registered. Subsequently, the base plate portion 20 is fixed by clasping down the mold die, and resin is poured into the mold cavity. Thereafter, upon the resin cooling and hardening, the base plate portion 20 and the hardened resin, which has become integrally formed with the base plate portion 20, are removed from the mold die. Accordingly, as shown in FIGS. 6 through 8, a surface-insulation portion 48, which covers substantially the entire surface of the base plate portion 20, is formed by this resin material. At this stage, since each of the anode conductive sections 28 and the cathode conductive sections 32 are connected via the cutoff bridges 23 and the circuit-design bridges 24, the conductive plate 17 does not become separated or shifted from the registered position. Note that in the case forming a long LED mounting module 15, a surface-insulation portion 48 is coated on one end portion of the conductive plate 17 using the mold die, and then upon separating the mold die, a portion of the conductive plate 17 that is adjacent the coated portion thereof (a portion which has not yet had a surface-insulation portion 48 formed thereon) is moved inside the mold die via a conveyer apparatus that is provided on the periphery of the mold die, and the surface-insulation portion 48 is formed on this adjacent portion. Accordingly, the entire conductive plate 17 is coated with the surface-insulation portion 48 by repeating this operation.

Figure 5:
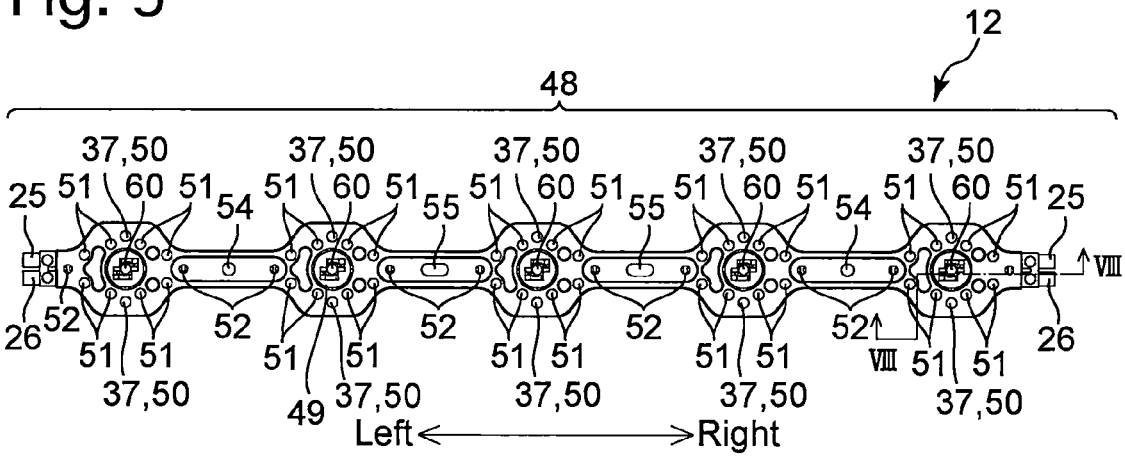
FIG. 5 is a front elevational view of an LED module with the diffusing lenses removed.

As shown in FIGS. 5 through 7, the surface-insulation portion 48 does not cover the ends of the anode electrical-supply segment 25 and the cathode electrical-supply segment 26. Furthermore, the surface-insulation portion 48 is provided with a central hole 49 for exposing the first holding segment 30, the second holding segment 34, the resiliently deformable portion 41 and the resiliently deformable portion 45 on the front surface of each LED fixing portion 36. Whereas, the fixing section 40 of each anode piece 39 and the fixing section 44 of each cathode piece 43 is covered by the surface-insulation portion 48. Furthermore, the front surface of the portions of the surface-insulation portion 48 that correspond to the front surfaces of the LED fixing portions 36 are each circularly shaped and have a greater thickness than the peripheral portion thereof, and these portions of the surface-insulation portion 48 each have an oblique peripheral surface (support portions) 56 (for registering and supporting a diffusing lens 64, which will be discussed later). Furthermore, the surface-insulation portion 48 is provided with molded holes 50 which are formed upon removing the above-mentioned register-pins from the register through-holes 37 after molding and have the same number as that of the register through-holes 37. The surface-insulation portion 48 also is provided with a total of eight exposure holes (exposed portions) 51, on portions that cover the front surface of each LED fixing portion 36, which expose portions of the front surface of each LED fixing portion 36, and a total of four exposure holes 51, on portions that cover the rear surface of each LED fixing portion 36, which expose portions of the rear surface of the LED fixing portion 36. Furthermore, since the surface-insulation portion 48 is provided, on the front and rear surfaces thereof, with cutoff holes 52 for exposing the front and rear sides of the cutoff bridges 23, all of the cutoff bridges 23 are physically cut (by cutting and separating each cutoff bridge 23 in two) by utilizing each cutoff hole 52 after the surface-insulation portion 48 is molded. Exposure holes (exposed portions) 53 for exposing the base portions of the first holding segment 30 and the second holding segment 34 are formed in the back surface of the surface-insulation portion 48. Round holes 54 and elongated holes 55, which are smaller than the through-holes 35, are formed in the surface-insulation portion 48 at portions that correspond to the through-holes 35. The round holes 54 and the elongated holes 55 can be utilized as screw-mounting holes or lock holes for fixing the LED module 12 to a chassis or a thermal radiator plate of an application (a device which mounts the LED module 12).

The above described the conductive plate 17 (the base plate portion 20, the anode piece 39, and the cathode piece 43) and the surface-insulation portion 48 are components of the LED mounting module 15.

In the illustrated embodiment, a total of five LED elements (semiconductor light-emitting elements) 60 and diffusing lenses 64 are mounted onto the LED mounting module 15, which is configured of the conductive plate 17 and the surface-insulation portion 48, so as to constitute the LED module 12.

Each LED element 60 is provided with a rectangular base plate 61 having (supporting) an anode (not shown) and a cathode (not shown) on the underside thereof, and a LED 62 which is connected to the anode and cathode that are supported by the base plate 61. Upon each LED element 60 being inserted into the central hole 49 of each corresponding LED fixing portion 36 and the base plate 61 being clasped by the first holding segment 30 and the second holding segment 34 so as to be in a fixed state (in which the first holding segment 30 and the second holding segment 34 are slightly resiliently deformed mutually away from each other), the above-mentioned anode that is formed on the underside of the base plate 61 contacts the resiliently deformable portion 41 of the anode piece 39 and the above-mentioned cathode that is formed on the underside of the base plate 61 contacts the resiliently deformable portion 45 of the cathode piece 43, so that a part of each LED element 60 is surrounded by the corresponding central hole 49 (i.e., a part of the LED element 60 is positioned in the central hole 49; see FIG. 8). Note that since the LED elements 60 have a predetermined polarity, it is practical for the central holes 49 to have an erroneous-insertion prevention key formed therein or for the LED elements 60 to have a recognition mark engraved on the front surfaces of the LED elements 60.

Figure 2:
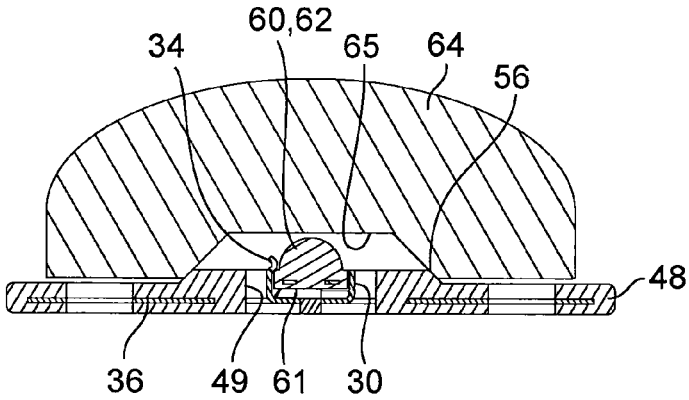
FIG. 2 is an enlarged sectional view taken along the II-II line shown in FIG. 1, viewed in the direction of the appended arrows.
Figure 3:
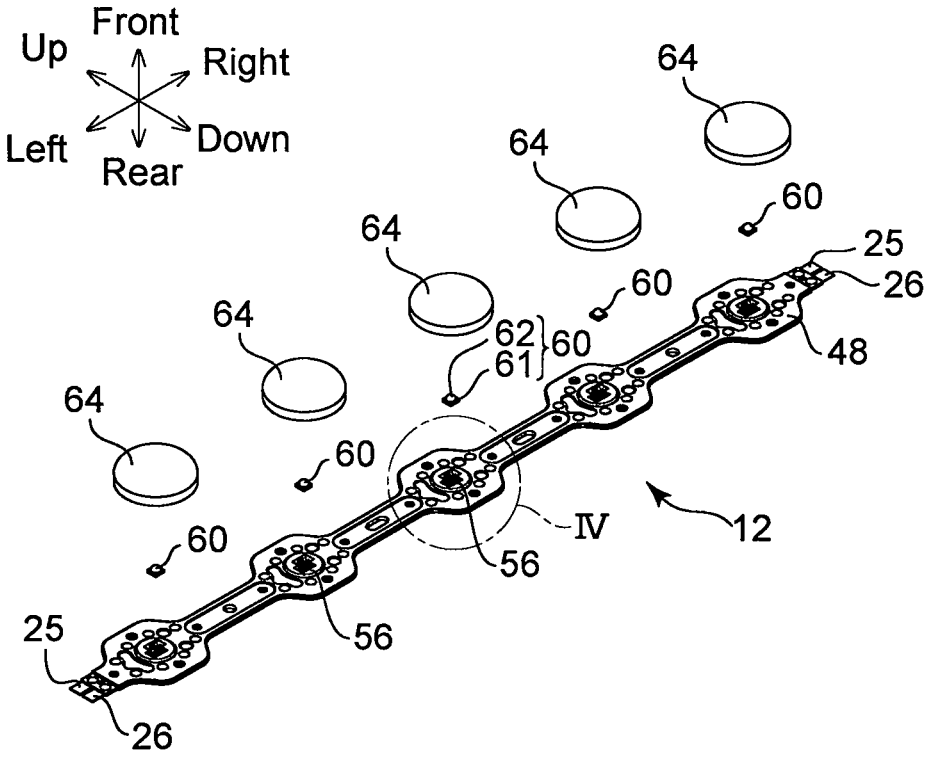
FIG. 3 shows a perspective exploded drawing of an LED mounting module with the diffusing lenses and LED element dismounted.
Figure 4:
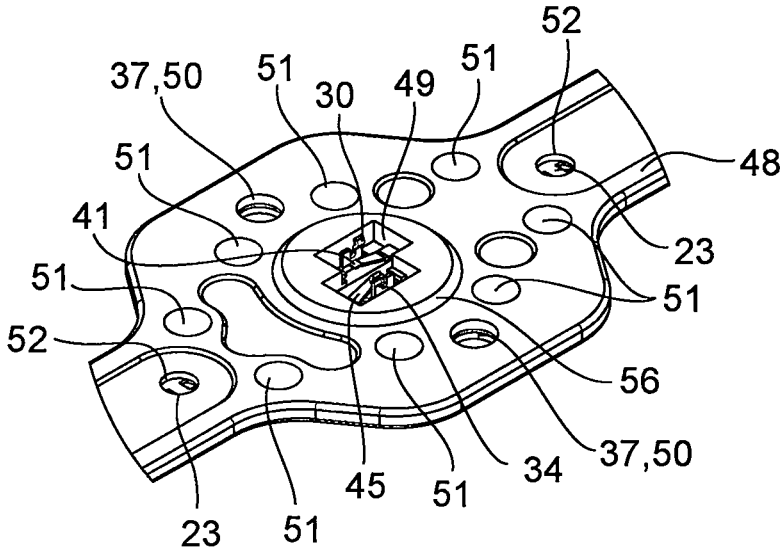
FIG. 4 is an enlarged view of section IV that is shown in FIG. 3.

Furthermore, a diffusing lens 64 having an underside recess 65 formed at the center of the underside surface thereof is fixed to the surface-insulation portion 48 by an adhesive, etc. As shown in FIG. 2, the diffusing lens 64 is positioned by an annular oblique surface that is formed on the peripheral surface of the underside recess 65 being fitted (surface contacted) onto the oblique peripheral surface 56 of the surface-insulation portion 48, so that upon the diffusing lens 64 being fixed onto the surface-insulation portion 48, the corresponding LED element 60 is positioned inside the underside recess 65 (the LED element 60 is positioned immediately behind the base of the underside recess 65).

Figure 15:
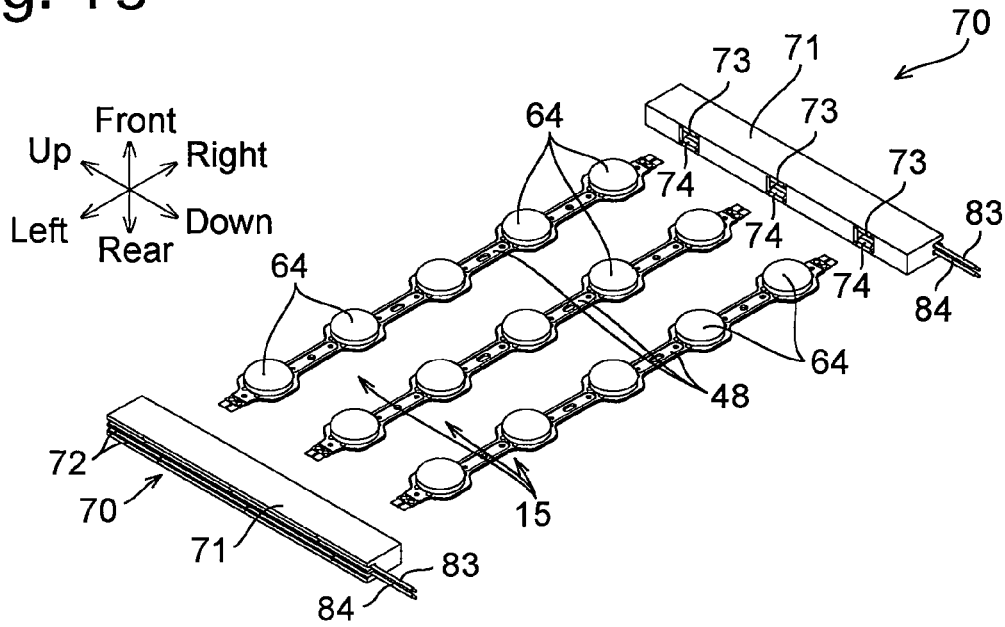
FIG. 15 is a perspective view showing a plurality of LED modules and a pair of side-connectors in a disassembled state.

Upon a plurality of LED modules 12 (only three of which are shown in FIGS. 15 and 16, though a much larger number are used in practice) being assembled in the above-described manner, each LED module 12 is arranged in a plane, as shown in FIG. 15, and left and right anode electrical-supply segments 25, and left and right cathode electrical-supply segments 26 are respectively connected to a pair of left and right side connectors 70.

Each side connector 70 is provided, as major components thereof, with an insulator 71, an anode contact (first connecting member) 75, a cathode contact (second connecting member) 76, a cable (first connecting member) 83 and a cable (second connecting member) 84.

The insulator 71 is a member that extends in the upward/rearward direction and is formed from a resin material that has insulation properties. A pair of front and rear cable holding grooves 72 are formed on the outer side surface of the insulator 71 in the longitudinal direction of the insulator 71, and a plurality of insertion holes 73 which are communicatively connected with the cable holding grooves 72 are formed on the inner side surface of the insulator 71 (although only three insertion holes 73 are shown in the drawings, the same number of insertion holes 73 as that of the LED modules 12 are provided in practice). Furthermore, a central projection 74 is provided inside each insertion hole 73 and defines a gap between the upper and lower surfaces and the front surface of each corresponding insertion hole 73.

Each pair of anode and cathode contacts 75 and 76 are both formed of metal, and each of the anode and cathode contacts 75 and 76 are provided with a pair of resilient contacts (connectors) 77 which the front/rear positions thereof are mutually deviated. The anode contact 75 is provided with a contact claw 78 which is positioned in a forward position with respect to the resilient contacts 77 and to which a conduction groove 79 is formed on the end surface thereof. The cathode contact 76 is provided with a contact claw 80 which is positioned in a rearward position with respect to the resilient contacts 77 and to which a conduction groove 81 is formed on the end surface thereof. Each pair of anode and cathode contacts 75 and 76 are fixed into a corresponding insertion hole 73 of the insulator 71. The contact claw 78 of each anode contact 75 is inserted into a gap on the upper side of the central projection 74 within the corresponding insertion holes 73, the contact claw 80 of each cathode contact 76 is inserted into a gap on the lower side of the central projection 74 within the corresponding insertion holes 73, and the resilient contacts 77 of each of the anode contacts 75 and the cathode contacts 76 are positioned inside the corresponding insertion hole 73.

The cable 83 and the cable 84 are both provided with an electrical wire 85 which constitutes the core, and a tubular cover 86 which is formed of an insulation material that covers the surface of the electrical wire 85. Upon the cable 83 being inserted into the front cable holding groove 72 of the insulator 71 and the cable 84 being inserted into the rear cable holding grooves 72 of the insulator 71, the cable 83 and the cable 84 are fitted into the conduction grooves 79 of the contact claws 78 and the conduction grooves 81 of the contact claws 80, respectively, and the conduction grooves 79 and the conduction grooves 81 break through the tubular covers 86, respectively, so as to come in contact with the electrical wires 85, respectively.

Figure 18:
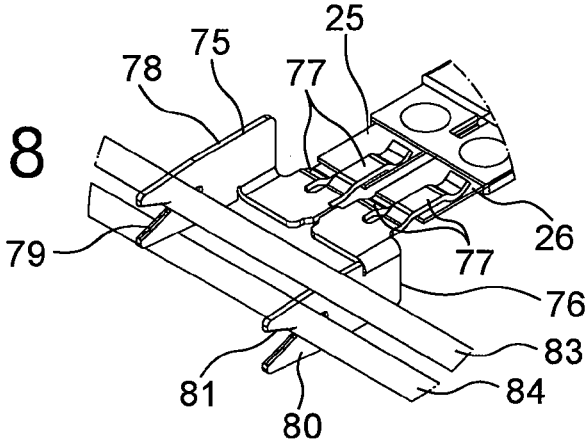
FIG. 18 is a perspective view showing a state in which a contact on the anode side and a contact on the cathode side are connected to an anode electrical-supply segment and a cathode electrical-supply segment, respectively, and are each connected to a cable.
Figure 19:
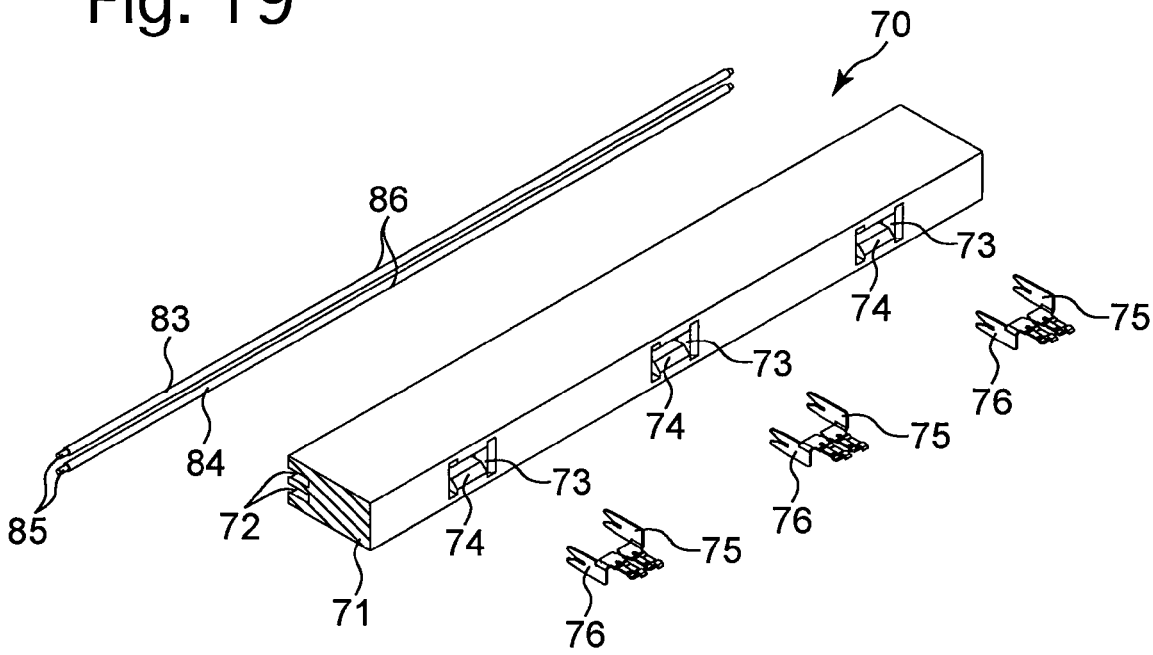
FIG. 19 is a perspective view of a side connector.
Figure 20:
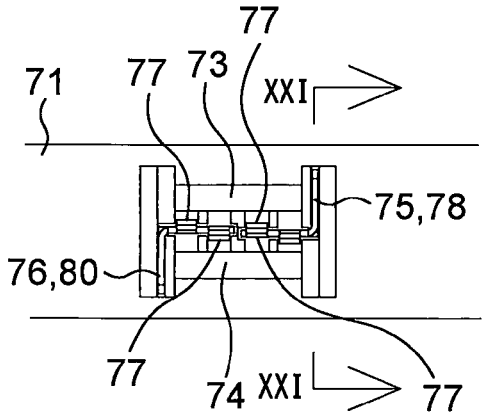
FIG. 20 is an enlarged view showing part of the internal surfaces of the side connector.
Figure 21:
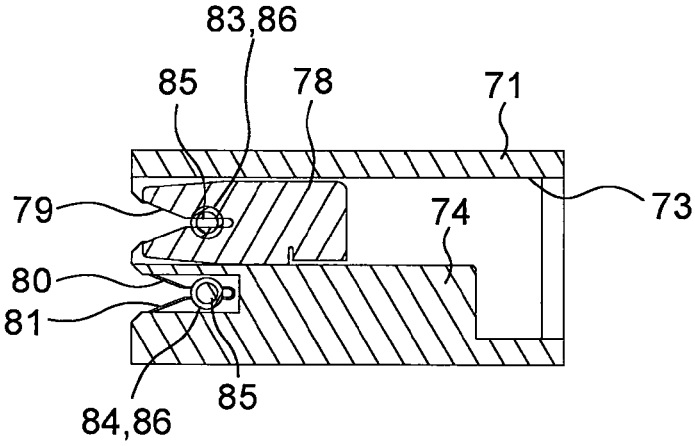
FIG. 21 is an enlarged sectional view taken along the XXI-XXI line shown in FIG. 20, viewed in the direction of the appended arrows.

Accordingly, upon inserting the left and right end portions of each LED module 12 into each corresponding insertion hole 73 provided in the left and right side connectors 70, which are assembled in the above-described manner, since the pair of anode and cathode electrical-supply segments 25 and 26 (at the left and right end portions of each LED module 12) are each clasped on the front and rear sides thereof by the front/rear resilient contacts 77 of each of the anode and cathode contacts 75 and 76 (FIG. 18), the left and right side connectors 70 and each LED module 12 become integral with each other.

Thereafter, an integrated unit of the LED modules 12 and the side connectors 70 is fixed onto the front surface of a metal (e.g., cold-rolled steel which has excellent press forming properties) chassis (thermal radiator plate) 90, and the rear surface of each LED mounting module 15 (surface-insulation portion 48) is brought into contact with the front surface of the chassis 90.

Lastly, the left and right sides of a film reflector plate 92, which is formed by having a light-reflection layer of metal such as aluminum, etc., vacuum deposited on the surface of polyethylene terephthalate (PET), or the like, and in which lens-exposing holes 93 having the same number and arrangement as the diffusing lenses 64 are formed, are fixed to the left and right side connectors 70, respectively, so that each diffusing lens 64 is exposed through each corresponding lens-exposing hole 93.

The LED light fixture 10, which is assembled in the above described manner, is positioned immediately behind an LCD panel (not shown) together with a deflection filter (not shown), and an electrical power source is connected to one end of the cable 83 and one end of the cable 84 of the left and right side connectors 70. Hence, upon a switch (not shown) being turned ON, an electrical current flows from the electrical power source to each LED module 12 via the cables 83 and 84.

Figure 13:
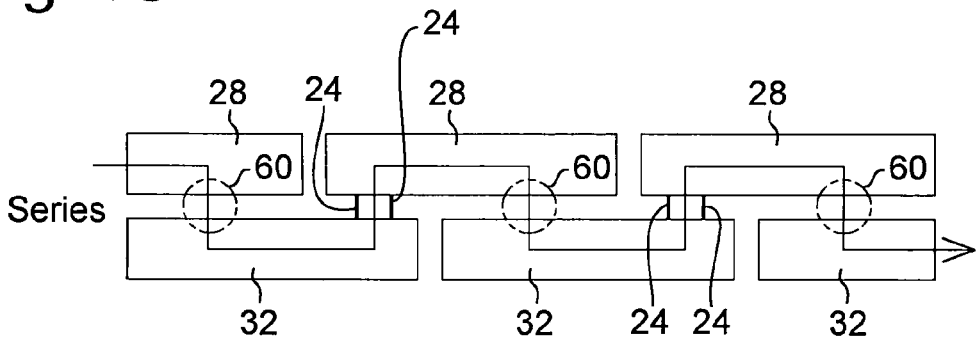
FIG. 13 is a schematic view of the conductive plate and the series circuit thereof.

As shown in FIG. 13, on the front surface of the conductive plate 17 in the illustrated embodiment, electrical current is conducted between the anode conductive sections 28 and the cathode conductive sections 32, which are respectively formed on a common LED fixing portion 36, by a corresponding anode piece 39, cathode piece 43, and LED element 60; since the (each) anode conductive section 28 and a cathode conductive section 32 formed on an LED fixing portion 36 that is adjacent to the LED fixing portion 36 to which this anode conductive section 28 is formed are electrical conductive via a circuit-design bridge 24, the front surface of the conductive plate 17 constitutes a series circuit. Therefore, upon an electrical current being applied to each LED module 12, light is emitted from each LED 62 that is provided in the above-described series circuit. The illumination light that is emitted from the LEDs 62 is dispersed by the diffusing lenses 64 and is reflected by the reflector plate 92 and travels in a forward direction upon passing through the deflection filter, and hence, the above-mentioned LCD panel carries out the indication operation.

According to the above-described embodiment, since a large number of LED elements 60 can be attached to a single conductive plate 17 with part of each LED elements 60 surrounded by the corresponding central hole 49, the thickness of the LED mounting modules 15 (LED modules 12) can be reduced while facilitating assembly and manufacture thereof, and furthermore, since the number of assembly procedures for the LED light fixture 10 of the LED modules 12 can be reduced, the LED light fixture 10 of the present invention has a favorable productivity.

Furthermore, since the surface of each conductive plate 17 is covered by the surface-insulation portion 48, the LED mounting modules 15 has favorable insulation. Furthermore, since the base plate portion 20 is formed from a single plate material, and is covered by the surface-insulation portion 48, the LED mounting modules 15 have a high rigidity.

It is possible to effectively transfer heat of the LED elements 60 to the conductive plates 17 via the first holding segments 30 and the second holding segments 34. Furthermore, it is possible to enlarge the area and thickness of the base plate portion 20, which is formed by a metal material having superior thermal conductivity and thermal radiativity. Additionally, since external thermal radiativity of heat that is transferred to the conductive plate 17 is also possible via the exposure holes 51 and 53, and the thin surface-insulation portion 48, the LED mounting modules 15 have superior thermal radiativity. Accordingly, the heat that is generated in each LED elements 60 is effectively radiated externally via the conductive plate 17, the thin surface-insulation portion 48, and the chassis (thermal radiator plate) 90.

Furthermore, the LED elements 60 can be fitted into the conductive plate 17 to be fixed thereto, and hence, can be efficiently assembled to each other since they need no reflow.

In addition, since no reflow is necessary, there is not danger of any of the LED elements 60 sustaining heat damage.

Furthermore, since the LED elements 60 are arranged on the series circuit which is formed on each conductive plate 17, it is possible to reduce variation of the luminance of the LED elements 60.

Since only the first holding segments 30 and the second holding segments 34, which support the LED elements 60, of the conductive plate 17 are formed by phosphor bronze that has superior spring properties, the overall cost of the conductive plate 17 can be lowered.

Since the base plate portion 20 other than the LED fixing portions 36, which mainly exhibit a radiation effect, can be made fine (narrow), the conductive plate 17 and the surface-insulation portion 48 can be made lighter in weight, and the manufacturing cost of the LED mounting modules 15 can be reduced.

In addition, since the surface-insulation portion 48 is provided with the oblique peripheral surfaces 56 for fixing the LED elements 60, the diffusing lenses 64 can be appropriately positioned on the LED mounting modules 15. Furthermore, since the diffusing lenses 64 having a diffusing function can be disposed close to the LED elements 60, the light that is emitted from the LED elements 60 can be efficiently diffused, and the height of the LED mounting modules 15 which include the diffusing lenses 64 can be reduced.

Furthermore, since the LED mounting modules 15 are mutually connected using the side connectors 70, the assembly of the LED light fixture 10 is simple.

In addition, by changing the type (positions) of bridges that are formed on the base plate portion 20 when the base plate portion 20 is stamped, various types of circuits can be easily constructed on the conductive plate 17.

Figure 22:
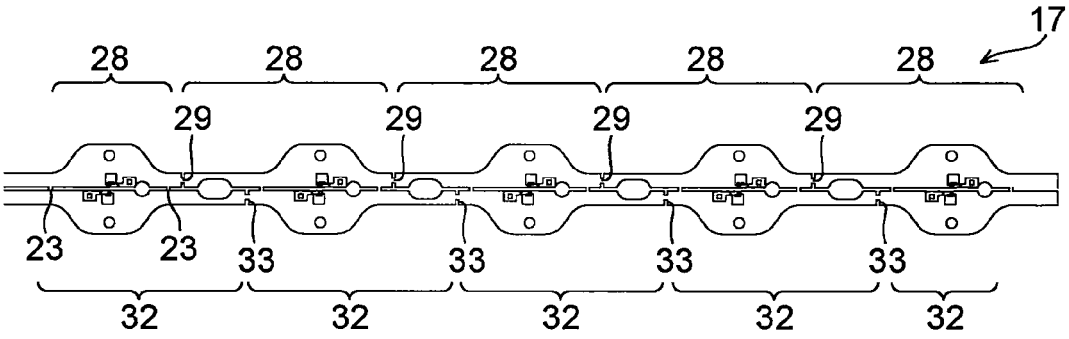
FIG. 22 is front elevational view of a conductive plate which is formed for use in a parallel circuit.
Figure 23:
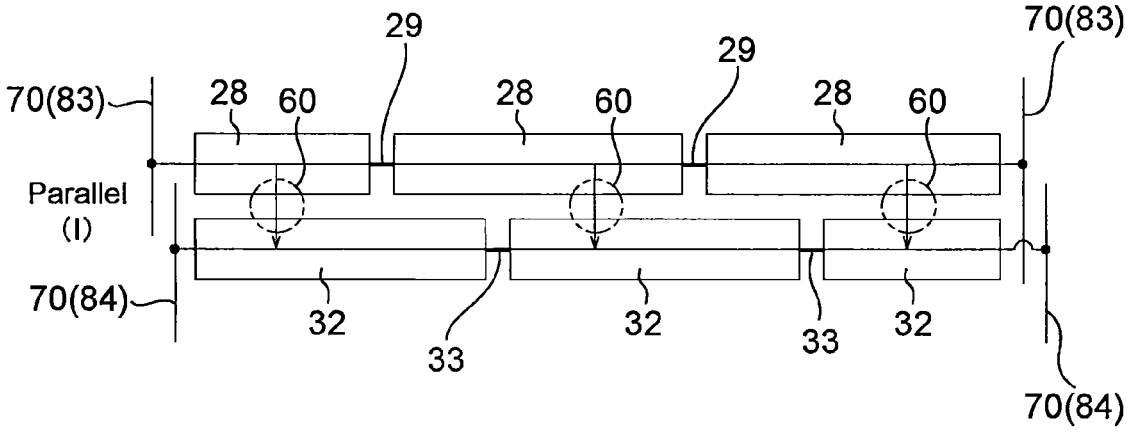
FIG. 23 is a schematic view of the conductive plate which is formed for use in a parallel circuit and of the parallel circuit thereof.

For example, FIGS. 22 and 23 show an example of a parallel circuit being formed on the conductive plate 17. In this modified embodiment of the conductive plate 17, anode bridges 29, which connect adjacent anode conductive sections 28, and cathode bridges 33, which connect adjacent cathode conductive sections 32, are formed by stamping; whereas, the circuit-design bridges 24 are not provided. Upon the LED elements 60 being attached to this modified embodiment of the conductive plate 17 (in which each cutoff bridge 23 is physically cut off after the surface-insulation portion 48 is molded), each anode electrical-supply segment 25 being connected to the cables 83 of the side connectors 70, and each cathode electrical-supply segment 26 being connected to the cables 84 of the side connectors 70, since adjacent anode conductive sections 28 are electrically conductive via the anode bridges 29, the adjacent cathode conductive sections 32 are electrically conductive via the cathode bridges 33, and the anode conductive sections 28 and the cathode conductive sections 32 which are formed on a common LED fixing portion 36 are electrically conductive via the corresponding anode piece 39, cathode piece 43 and LED elements 60, as shown in FIG. 23, a parallel circuit is hence formed on the front surface of the conductive plate 17. Accordingly, even if one LED element 60 were to break or stop working, since the other LED elements 60 still continue to emit light, such a structure is suitable for use in a device (such as the LED light fixture 10, etc.) which demands a long operating life and reliability.

Figure 24:
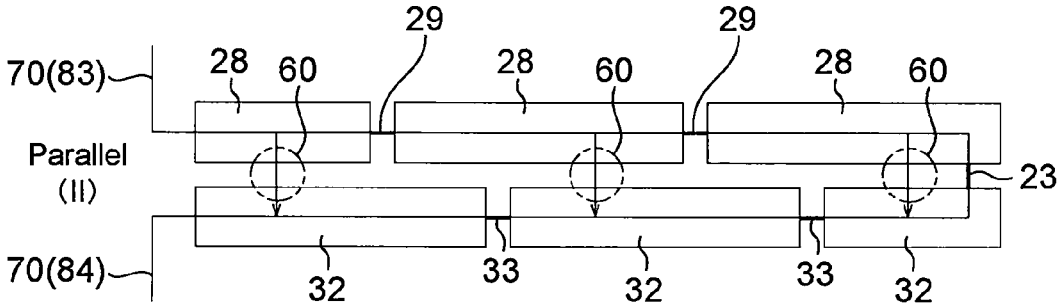
FIG. 24 is a schematic view of a different type of conductive plate which is formed for use in a parallel circuit and of the parallel circuit thereof.

FIG. 24 shows another modified embodiment of a parallel circuit that is formed on the conductive plate 17 which is different to that of FIGS. 22 and 23. This modified embodiment of the conductive plate 17 is distinguished from the conductive plate 17 of FIG. 22 in that the cutoff bridge (end bridge) 23 that is positioned at one end of the conductive plate 17 (right end of the conductive plate 17 in FIG. 24) remains (is not cut off), and the anode electrical-supply segments 25 and the cathode electrical-supply segments 26 that are positioned at the end portion of the conductive plate 17 at the cutoff bridge 23 side are not connected to the side connector 70 (the cables 83 and 84). If such a parallel circuit is formed on the conductive plate 17, the amount of wiring (the right side connector 70) can be reduced compared to the parallel circuit of FIGS. 22 and 23, while the same effect can be exhibited in the case of the parallel circuit of FIGS. 22 and 23. Note that in the case where the parallel circuit of FIG. 24 is formed, it is acceptable for the anode conductive section 28 and the cathode conductive section 32, which are formed on the LED fixing portion 36 at one end portion of the base plate portion 20 by stamping, to be connected by a bridge other than a cutoff bridge 23 and for all of the cutoff bridges 23 to be physically cut off.

Note that it is acceptable for all of the bridges (the cutoff bridges 23, the circuit-design bridges 24, the anode bridges 29 and the cathode bridges 33) to be formed on the base plate portion 20 by stamping, and thereafter, some of the bridges to be physically cut off, selectively, so that a desired electrical circuit is formed on the conductive plate 17.

Although the present invention has been described based on the above embodiments, various other alternative embodiments are possible.

For example, the base plate portion 20 can be formed from a metal material having superior conductivity, thermal conduction properties, and thermal radiativity, other than the above-described metal materials; and the anode pieces 39 and the cathode pieces 43 can be formed from a metal material having superior resiliency and conductivity, other than phosphor bronze. Furthermore, the base plate portion 20, the anode pieces 39 and the cathode pieces 43 can be integrally formed by forming the conductive plate 17 out of a metal material that has superior conductivity, resiliency, and thermal radiativity.

Furthermore, instead of the exposure holes 51, the surface-insulation portion 48 can be cutouts/notches, etc., for exposing the conductive plate 17.

Furthermore, the number of the LED fixing portions 36 that are formed on the base plate portion 20 (the number of LED elements 60 and the diffusing lenses 64 that can be mounted on one LED mounting module 15), and the number of the LED modules 12 with which one LED light fixture 10 is provided are not limited those disclosed in the embodiments.

In addition, the reflector plate 92 may be omitted from the LED light fixture 10.

It is acceptable for the chassis 90 to be formed by a conductive metal material, a circuit to be formed on the chassis 90 via printing, etc., for all of the bridges (the cutoff bridges 23, the circuit-design bridges 24, the anode bridges 29 and the cathode bridges 33) to be cut off, for a plurality of conductive pins formed of a conductive metal material and connected to the circuit to be provided on the front surface of the chassis 90, and for each conductive pin to pass through the exposed holes 51 and contact the anode conductive sections 28 and the cathode conductive sections 32 of each LED mounting module 15.

According to this modified embodiment, the circuit design can be freely changed by changing the number and arrangement of the conductive pins that are provided on the chassis 90.

Furthermore, it is acceptable to allow the base plate portion 20 of the LED module 12 to contact the chassis 90 (upon ensuring that a short circuit does not occur) in order to improve thermal radiativity.

Such a design change can be achieved by, for example, forming a metal contact projection on the base plate portion 20 that externally projects from the exposure holes of the surface-insulation portion 48, and allowing these contact projections to contact the chassis 90, or alternatively, by forming metal contact projections on the chassis 90, allowing these contact projections to pass through the exposure holes so as to contact the base plate portion 20. Furthermore, it is acceptable to provide metal contact springs, which are similar to the anode pieces 39 and the cathode pieces 43, on the base plate portion 20, and for the contact springs to pass through the exposure holes and contact the chassis 90.

It is acceptable to install a LED module(s ) 12 (either one LED module 12, or a plurality of LED modules 12 that are arrangement linearly and electrically connected to each other) inside a cylindrical tube made of a transparent material so as to constitute a interior light fixture.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A semiconductor light-emitting element mounting module comprising:

a conductive plate including a plurality of semiconductor light-emitting fixing portions arranged along said conductive plate, and two pairs of first and second electrical-supply segments, wherein each of said semiconductor light-emitting fixing portions includes a first conductive section and a second conductive section; and a first contact and a second contact, wherein one end of said first contact and one end of said second contact are in contact with said first conductive section and said second conductive section, respectively, and the other end of said first contact and said second contact is electrically conductive with an anode and a cathode of an light-emitting element, respectively, and wherein one pair of said first and second electrical-supply segments are electrically conductive with the first and second conductive sections that are provided at one end of said conductive plate, respectively, and the other pair of said first and second electrical-supply segments are electrically conductive with the first and second conductive sections that are provided at the other end of said conductive plate, respectively; and a surface-insulation portion formed from a resin material and which covers the surface of said conductive plate with said other end of said first and second contacts exposed, and with each of the first electrical-supply segments and each of the second electrical-supply segments exposed.

2. The semiconductor light-emitting element mounting module according to claim 1, wherein a pair of fixing pieces are provided on said each of said semiconductor light-emitting fixing portions, wherein each said pair of fixing pieces can clasp said semiconductor light-emitting element so as to fix said semiconductor light-emitting element to a corresponding said semiconductor light-emitting fixing portion, and wherein said surface-insulation portion exposes each said pair of fixing pieces.

3. The semiconductor light-emitting element mounting module according to claim 1, wherein each of said first conductive sections, which are mutually separated from each other, is electrically conductive with a corresponding said second conductive section, which is provided on a common said semiconductor light-emitting fixing portion, and is connected with another said second conductive section of another said semiconductor light-emitting fixing portion that is positioned in a longitudinal direction of said conductive plate.

4. The semiconductor light-emitting element mounting module according to claim 1, wherein said first conductive sections are mutually connected to each other, and said second conductive sections are mutually connected to each other, wherein said first and second conductive sections are mutually separate from each other, and wherein each of said first conductive sections is conductive with a corresponding said second conductive section which is provided on a common said semiconductor light-emitting fixing portion.

5. The semiconductor light-emitting element mounting module according to claim 1, wherein said first conductive sections are mutually connected to each other, and said second conductive sections are mutually connected to each other, wherein only the first and second conductive segments of the semiconductor light-emitting fixing portion which is positioned at one end of said conductive plate are mutually connected, and wherein each of said first conductive sections is conductive with a corresponding said second conductive section which is provided on a common said semiconductor light-emitting fixing portion.

6. The semiconductor light-emitting element mounting module according to claim 1, wherein said first and second contacts comprise first and second contact pieces, respectively, wherein each of said first and second contact pieces is formed as a separate member from said semiconductor light-emitting fixing portion and is formed by a resilient metal, and wherein one end of said first contact piece and one end of said second contact piece are in contact with said first conductive section and said second conductive section, respectively, and the other end of said first contact and said second contact is separated from said semiconductor light-emitting fixing portion and is electrically conductive with an anode and a cathode of an light-emitting element, respectively.

7. The semiconductor light-emitting element mounting module according to claim 1, wherein said semiconductor light-emitting fixing portion is wider than the width of the remaining portions of said conductive plate.

8. The semiconductor light-emitting element mounting module according to claim 1, wherein said surface-insulation portion comprises at least one exposed portion for exposing part of said conductive plate.

9. The semiconductor light-emitting element mounting module according to claim 1, wherein said first conductive section is connected to said corresponding second conductive section, which is provided on said common semiconductor light-emitting fixing portion, by a cutoff bridge, wherein said cutoff bridge can be physically cut off from said common semiconductor light-emitting fixing portion.

10. The semiconductor light-emitting element mounting module according to claim 1, wherein said surface-insulation portion comprises a support portion for supporting a diffusing lens, which diffuses light that is emitted from said semiconductor light-emitting element.

11. A semiconductor light-emitting element module comprising the semiconductor light-emitting element mounting module according to claim 1; and a light-emitting element, wherein an anode and a cathode of said light-emitting element are electrically conductive with said first contact portion and said second contact portion, respectively, of said semiconductor light-emitting element mounting module.

12. A semiconductor light-emitting element light fixture comprising:

a plurality of the semiconductor light-emitting element modules according to claim 11, said plurality of semiconductor light-emitting element modules being arranged in a direction that is orthogonal to the longitudinal direction of said conductive plates;

a plurality of pairs of first connecting members, wherein one of each said pair of first connecting members mutually connects with said first electrical-supply segments at one common end of said semiconductor light-emitting element mounting modules, and the other of said each pair of first connecting members mutually connects with said first electrical-supply segments at the other common end of said semiconductor light-emitting element mounting modules;

a plurality of pairs of second connecting members, wherein one of each said pair of second connecting members mutually connects with said second electrical-supply segments at said one common end of said semiconductor light-emitting element mounting modules, and the other of said each pair of second connecting members mutually connects with said second electrical-supply segments at said other common end of said semiconductor light-emitting element mounting modules; and a pair of insulators, wherein one of said pair of insulators supports said first connecting members and said second connecting members at said one common end of said semiconductor light-emitting element mounting modules, and the other of said pair of insulators supports said first connecting members and said second connecting members at said other common end of said semiconductor light-emitting element mounting modules.

13. A semiconductor light-emitting element light fixture comprising:

a plurality of the semiconductor light-emitting element modules according to claim 11, said plurality of semiconductor light-emitting element modules being arranged in a direction that is orthogonal to the longitudinal direction of said conductive plates;

a plurality of pairs of first connecting members, wherein one of each said pair of first connecting members mutually connects with said first electrical-supply segments at one common end of said semiconductor light-emitting element mounting modules;

a plurality of pairs of second connecting members, wherein one of each said pair of second connecting members mutually connects with said second electrical-supply segments at said one common end of said semiconductor light-emitting element mounting modules; and an insulator which supports said first connecting members and said second connecting members, respectively.

14. The semiconductor light-emitting element light fixture according to claim 12, wherein at least one of said first connecting member and said second connecting member comprises:

a metal connecting member including a connector which connects to one of said first electrical-supply segment and said second electrical-supply segment, and a conduction groove; and an electrical wire which is supported by said conduction groove.

15. The semiconductor light-emitting element light fixture according to claim 13, wherein at least one of said first connecting member and said second connecting member comprises:

a metal connecting member including a connector which connects to one of said first electrical-supply segment and said second electrical-supply segment, and a conduction groove; and an electrical wire which is supported by said conduction groove.

16. The semiconductor light-emitting element light fixture according to claim 14, wherein said connector comprises a pair of resilient contacts which clasps both surfaces of one of said first electrical-supply segment and said second electrical-supply segment.

17. The semiconductor light-emitting element light fixture according to claim 15, wherein said connector comprises a pair of resilient contacts which clasps both surfaces of one of said first electrical-supply segment and said second electrical-supply segment.

18. The semiconductor light-emitting element light fixture according to claim 12, further comprising:

a chassis, which is provided with a circuit and a plurality of metal conductive pins which are connected to said circuit, wherein said semiconductor light-emitting element modules are fixed onto said chassis, wherein each of said first conductive sections and said second conductive sections are mutually separated from each other, wherein said surface-insulation portion is provided with at least one exposed portion for partially exposing each of said first conductive sections and said second conductive sections, and wherein said conductive pins are brought in contact with said first conductive sections and said second conductive sections through said at least one exposed portion.

19. The semiconductor light-emitting element light fixture according to claim 18, wherein said chassis is formed of metal.

20. A manufacturing method of a semiconductor light-emitting element mounting module, comprising:

stamp-forming a conductive plate, said conductive plate including a plurality of semiconductor light-emitting fixing portions linearly arranged along said conductive plate, two pairs of first and second electrical-supply segments, and a cutoff bridge, wherein each of said semiconductor light-emitting fixing portions includes a first conductive section and a second conductive section; and a first contact and a second contact, wherein one end of said first contact and one end of said second contact are in contact with said first conductive section and said second conductive section, respectively, and the other end of said first contact and said second contact is electrically conductive with an anode and a cathode of an light-emitting element, respectively, wherein one pair of said first and second electrical-supply segments are electrically conductive with the first and second conductive sections that are provided at one end of said conductive plate, respectively, and the other pair of said first and second electrical-supply segments are electrically conductive with the first and second conductive sections that are provided at the other end of said conductive plate, respectively, wherein said first conductive section is connected to a corresponding said second conductive section which is provided on a common semiconductor light-emitting fixing portion by said cutoff bridge, wherein said cutoff bridge can be physically cut off from said common semiconductor light-emitting fixing portion, and wherein said first conductive section is connected to the second conductive section of another of said semiconductor light-emitting fixing portions, which is positioned to one side of the semiconductor light-emitting fixing portion of said first conductive section in the longitudinal direction of said conductive plate;

covering the surface of said conductive plate with a surface-insulation portion which is formed of resin with said other end of said first and second contacts exposed, and with each of the first electrical-supply segments and each of the second electrical-supply segments exposed; and physically cutting off each of said cutoff bridges.

21. A manufacturing method of a semiconductor light-emitting element mounting module, comprising:

stamp-forming a conductive plate, said conductive plate including a plurality of semiconductor light-emitting fixing portions linearly arranged along said conductive plate, two pairs of first and second electrical-supply segments, and a cutoff bridge, wherein each of said semiconductor light-emitting fixing portions includes a first conductive section and a second conductive section; and a first contact and a second contact, wherein one end of said first contact and one end of said second contact are in contact with said first conductive section and said second conductive section, respectively, and the other end of said first contact and said second contact is electrically conductive with an anode and a cathode of an light-emitting element, respectively, wherein one pair of said first and second electrical-supply segments are electrically conductive with the first and second conductive sections that are provided at one end of said conductive plate, respectively, and the other pair of said first and second electrical-supply segments are electrically conductive with the first and second conductive sections that are provided at the other end of said conductive plate, respectively, wherein said first conductive section is connected to a corresponding said second conductive section which is provided on a common semiconductor light-emitting fixing portion by said cutoff bridge, wherein said cutoff bridge can be physically cut off from said common semiconductor light-emitting fixing portion, and wherein said first conductive sections are connected to each other, and said second conductive sections are connected to each other;

covering the surface of said conductive plate with a surface-insulation portion which is formed of resin with said other end of said first and second contacts exposed, and with each of the first electrical-supply segments and each of the second electrical-supply segments exposed; and physically cutting off each of said cutoff bridges.

22. A manufacturing method of a semiconductor light-emitting element mounting module, comprising:

stamp-forming a conductive plate, said conductive plate including a plurality of semiconductor light-emitting fixing portions linearly arranged along said conductive plate, two pairs of first and second electrical-supply segments, an end bridge, and a cutoff bridge, wherein each of said semiconductor light-emitting fixing portions includes a first conductive section and a second conductive section; and a first contact and a second contact, wherein one end of said first contact and one end of said second contact are in contact with said first conductive section and said second conductive section, respectively, and the other end of said first contact and said second contact is electrically conductive with an anode and a cathode of an light-emitting element, respectively, wherein one pair of said first and second electrical-supply segments are electrically conductive with the first and second conductive sections that are provided at one end of said conductive plate, respectively, and the other pair of said first and second electrical-supply segments are electrically conductive with the first and second conductive sections that are provided at the other end of said conductive plate, respectively, wherein said end bridge connects the first conductive section to the second conductive section, which are positioned at one end of said conductive plate in the longitudinal direction thereof;

wherein said cutoff bridge connects said first conductive section to a corresponding said second conductive section which is provided on a common said semiconductor light-emitting fixing portion, wherein said cutoff bridge can be physically cut off from said common semiconductor light-emitting fixing portion, and wherein said first conductive sections are connected to each other, and said second conductive sections are connected to each other;

covering the surface of said conductive plate with a surface-insulation portion which is formed of resin with said other end of said first and second contacts exposed, and with each of the first electrical-supply segments and each of the second electrical-supply segments exposed; and physically cutting off each of said cutoff bridges.

* * * * *